US006000195A

United States Patent [19]

Jakobsson

[11] Patent Number: 6,000,195

[45] Date of Patent: Dec. 14, 1999

[54] PACKAGING MACHINE WITH CAPABILITY TO CONVERT TO DIFFERENT CARTON CROSS-SECTIONS

[75] Inventor: Ronnie Jakobsson, Wheeling, Ill.

[73] Assignee: Tetra Laval Holdings & Finance, SA, Pully, Switzerland

[21] Appl. No.: 09/067,117

[22] Filed: Apr. 27, 1998

[51] Int. Cl.[6] ..... B65B 59/00

[52] U.S. Cl. ..... 53/201; 53/250; 53/257; 53/202; 53/565

[58] Field of Search ..... 53/201, 257, 250, 53/249, 168, 202, 565, 564; 493/478, 479, 477, 165, 164; 141/104, 100, 99

[56] References Cited

U.S. PATENT DOCUMENTS

| | | | |
|---|---|---|---|
| 3,045,720 | 7/1962 | Jungmayr et al. | 141/145 |
| 3,619,979 | 11/1971 | Martensson et al. | 53/201 X |
| 3,964,239 | 6/1976 | Elford | 53/228 X |
| 4,553,079 | 11/1985 | Igarashi et al. | 318/626 |
| 4,751,805 | 6/1988 | Walter | 53/201 |
| 4,790,123 | 12/1988 | Ljungström et al. | 53/458 |
| 4,999,979 | 3/1991 | Vicq | 53/201 X |
| 5,056,294 | 10/1991 | Focke | 53/201 |
| 5,460,262 | 10/1995 | Kennedy et al. | 198/84 |
| 5,517,798 | 5/1996 | Klopfenstein | 53/201 X |
| 5,531,056 | 7/1996 | Liang | 53/251 |
| 5,553,441 | 9/1996 | Ivansco, Jr. et al. | 53/249 |
| 5,706,627 | 1/1998 | Kirka et al. | 53/52 |

FOREIGN PATENT DOCUMENTS

| | | |
|---|---|---|
| 9630263 | 10/1996 | WIPO . |
| 9630264 | 10/1996 | WIPO . |
| 9631391 | 10/1996 | WIPO . |

*Primary Examiner*—James F. Coan
*Attorney, Agent, or Firm*—Welsh & Katz, Ltd.

[57] ABSTRACT

A packaging that is capable to simultaneously process cartons having two different cross-sections, or to convert from processing a carton having one cross-section to a processing cartons having another cross-section. Using TETRA REX® gable top cartons as an example, a dual line packaging machine may process cartons having a 95 mm×70 mm cross-section on one line and process cartons having a 95 mm×95 mm cross-section on the other line. The packaging machine may have eccentric housing column for simple adjustments of the width of the lines.

16 Claims, 11 Drawing Sheets

PACKAGING MACHINE WITH CAPABILITY TO CONVERT TO DIFFERENT CARTON CROSS-SECTIONS

CROSS REFERENCES TO RELATED APPLICATIONS

Not Applicable STATEMENT REGARDING FEDERALLY SPONSORED RESEARCH OR DEVELOPMENT

Not Applicable

BACKGROUND OF THE INVENTION

1. Field of the Invention

The present invention relates to linear form, fill and seal packaging machines. Specifically, the present invention relates to a packaging machine which may be easily converted from processing one carton cross-section to processing another carton cross-section, and to a packaging machine capable of processing two different size cartons at once.

2. Description of the Related Art

Packaging machines are known that integrate into a single unit the various components necessary to form a container, fill the container with a liquid product, and seal the container. Such packaging machines typically first transfer carton blanks from a magazine onto a mandrel of the machine for bottom forming of the cartons. The carton blank is erected in transit from the magazine to the mandrel. The erected and bottom formed carton is then placed on a conveyor line and in an indexed motion, conveyed to various stations along the packaging machine. The cartons are held in place by a plurality of carton guides connected to a conveyor chain. The carton guides are set to tightly hold each of the cartons in a predetermined position. Several optional stations are fitment application stations and sterilization stations. Required stations, usually downline from these optional stations include a filling station and a top sealing station. At the filling station, each of the cartons is filled with a product dispensed from a product storage tank. Bottom-up filling is a preferred processing technique in which the carton is lifted up to the filling nozzle/tube and then filled as it is lowered therefrom. From the filling station, the carton proceeds to a top sealing station where the top of the carton is folded together and then sealed either ultrasonically or through heat. The carton is then ready for distribution.

In order to increase production capacity, some of these packaging machines have ben configured with two processing lines. An example of such a machine is the TR/8 TETRA REX® packaging machine available from Tetra Pak, Incorporated of Chicago, Ill. which is described in U.S. Pat. No. 4,790,123 for a Method And A Machine For The Manufacturing Of Packing Containers, issued on Dec. 13, 1988 which is hereby incorporated by reference. These dual line machines would have the very same processing stations on both lines. For example, line one would have a filling station and line two would have the same exact filling station. This was because both lines were driven off a single cam drive located beneath the platform of the packaging machine. The single cam drive would engage with a number of cams and gears to operate the various stations along the packaging machine. In one embodiment, when one line was active, the other line was inactive.

Current servomotor technology has allowed for the "individuality" of the various stations thereby allowing them independence from the single cam drive for performing their functions. However, servomotors have failed to completely render both lines on a dual line machine independent of each other.

BRIEF SUMMARY OF THE INVENTION

One aspect of the present invention is a packaging machine capable of processing multiple cartons simultaneously at a plurality of processing stations. The packaging machine includes first and second continuous chain assemblies for transferring the series of cartons from and to each of the plurality of processing stations. Each of the first and second continuous chain assemblies has a plurality of guides. Each chain assembly is connected to a front column on one end and a rear column on the other end. The front and rear columns each has an eccentric housing for moving the first and second continuous chains traverse to the conveyance line from a first position to a second position. The first position corresponding to a first carton pocket configuration and the second position corresponding to a second carton pocket configuration. The packaging machine also has a plurality of removeable fill pipes. One set of fill pipes corresponds to a first carton cross-section and another set of fill pipes corresponds to a second carton cross-section.

It is a primary object of the present invention to provide a packaging machine capable of processing two different sizes of cartons simultaneously.

It is an additional object of the present invention to provide a packaging machine capable of easily converting from processing one carton size to processing another carton size.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a top perspective view of a packaging machine of the present invention;

Figure 1:
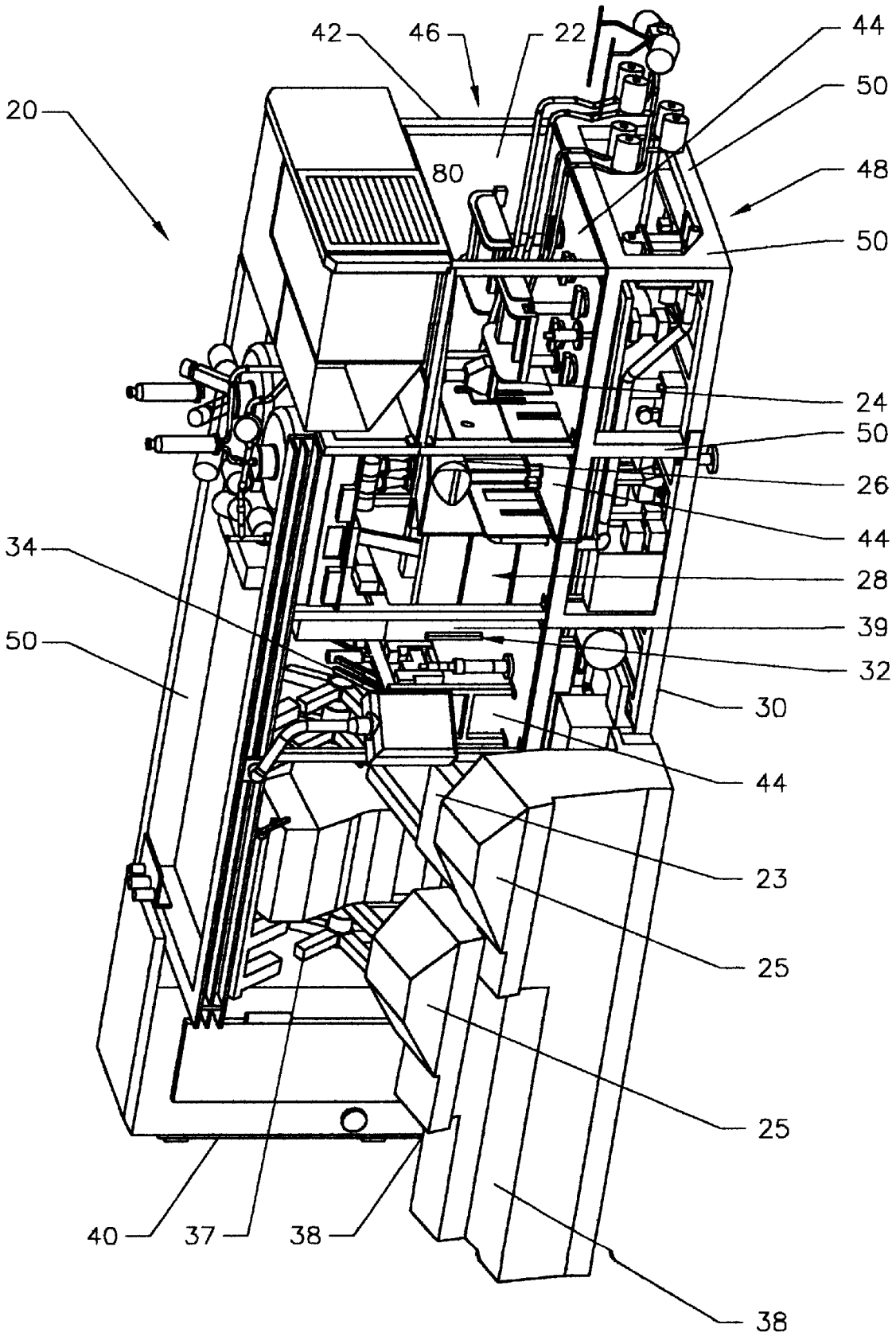
Figure 2:
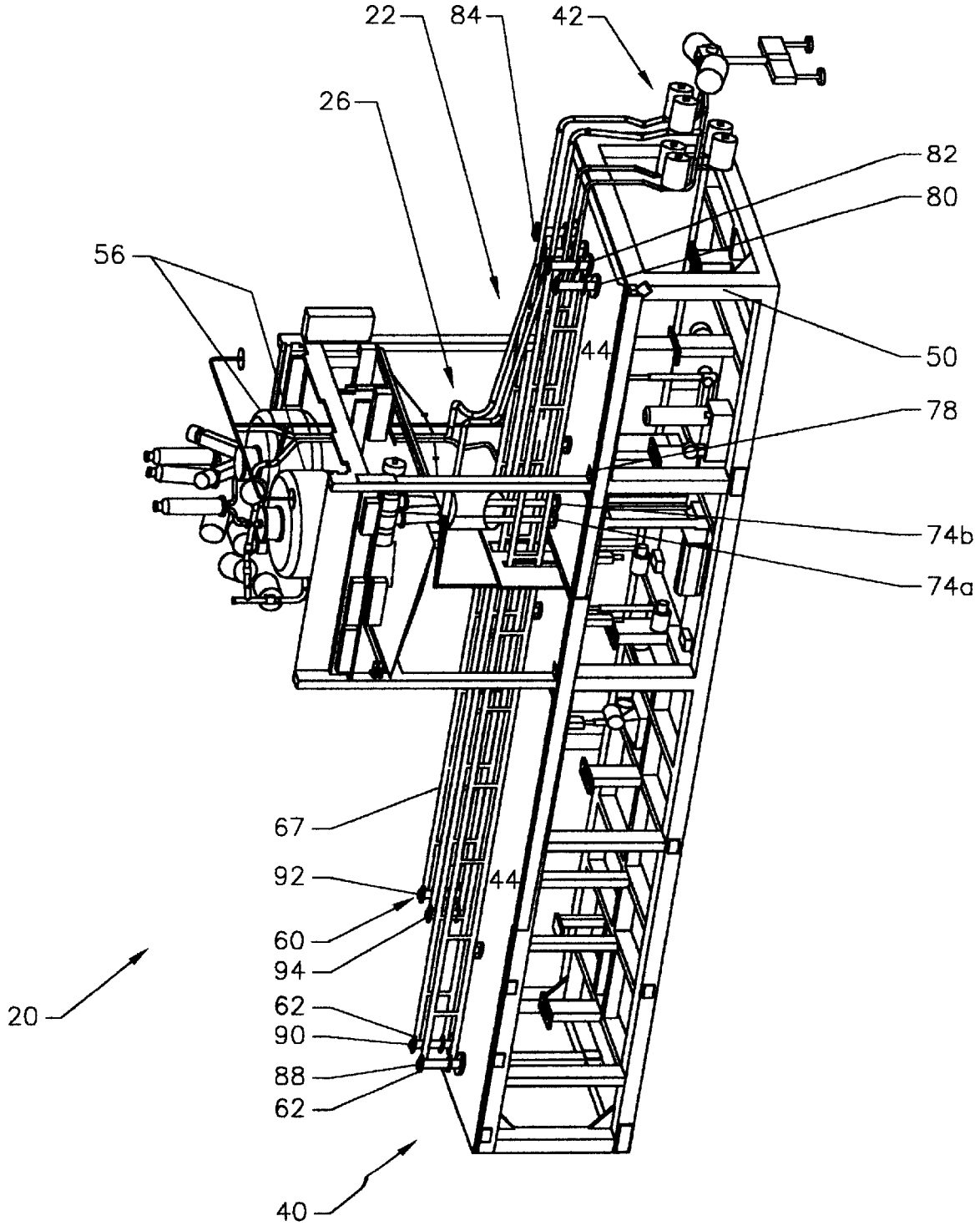
Figure 3:
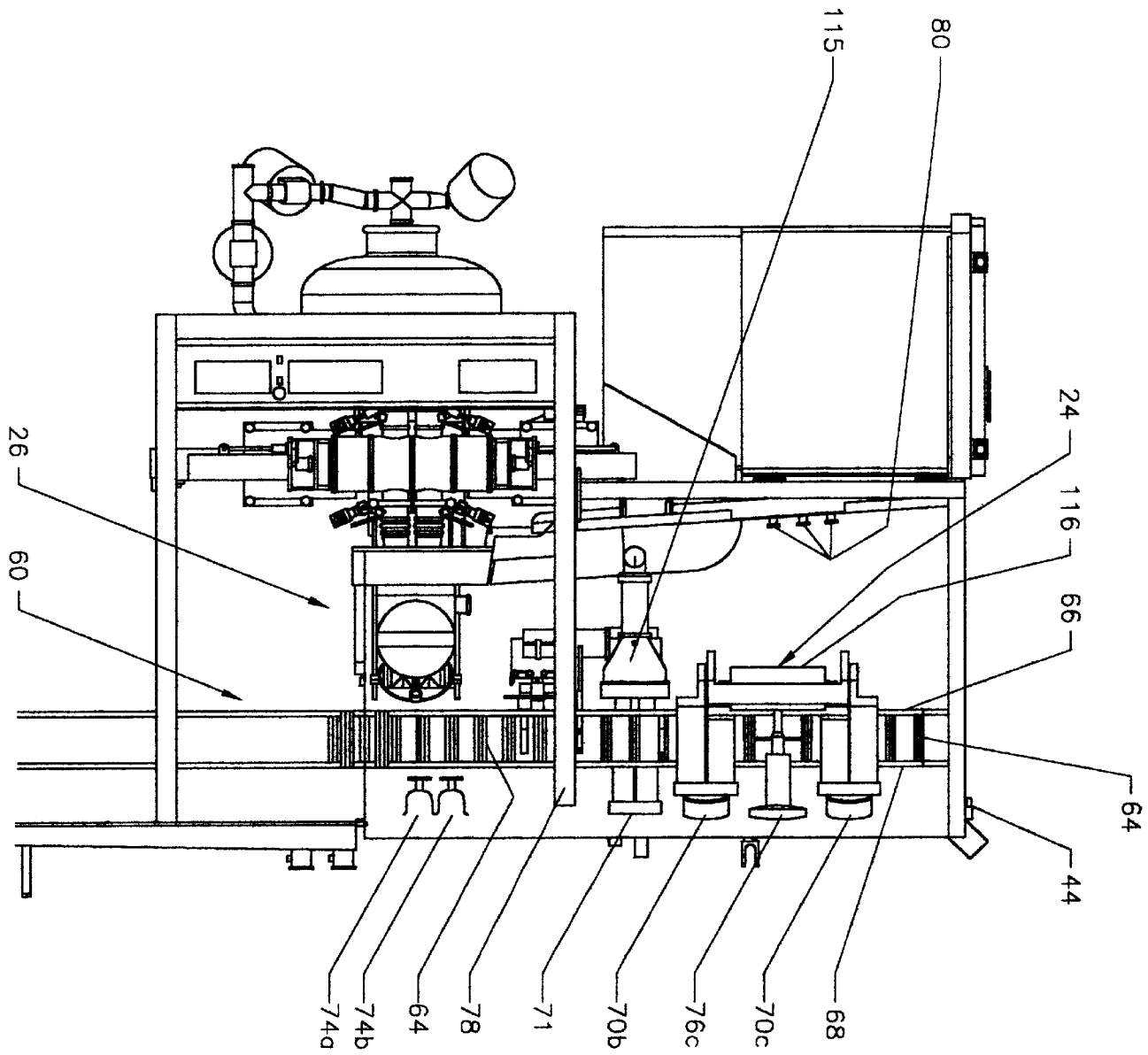
Figure 3A:
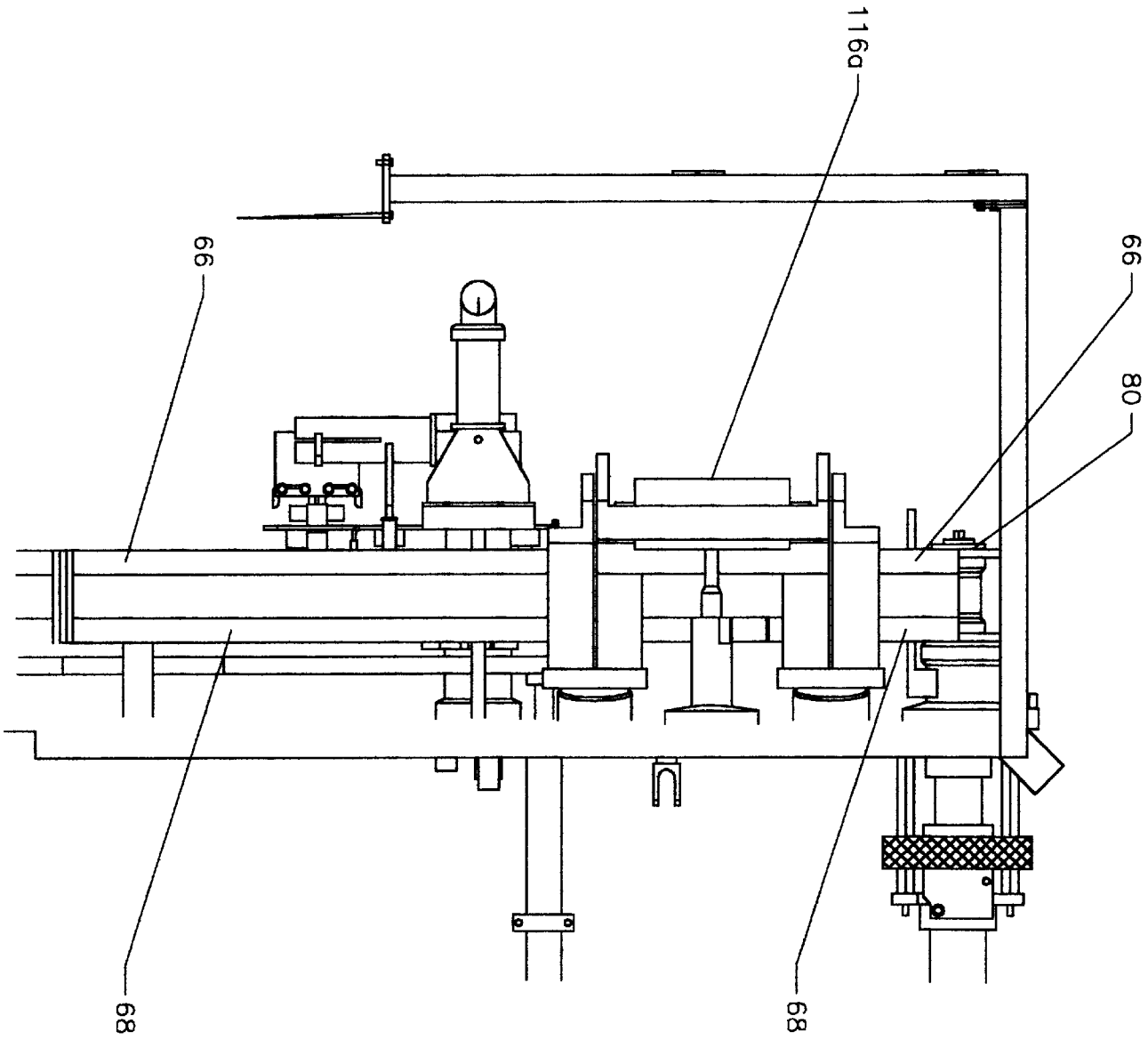
Figure 4:
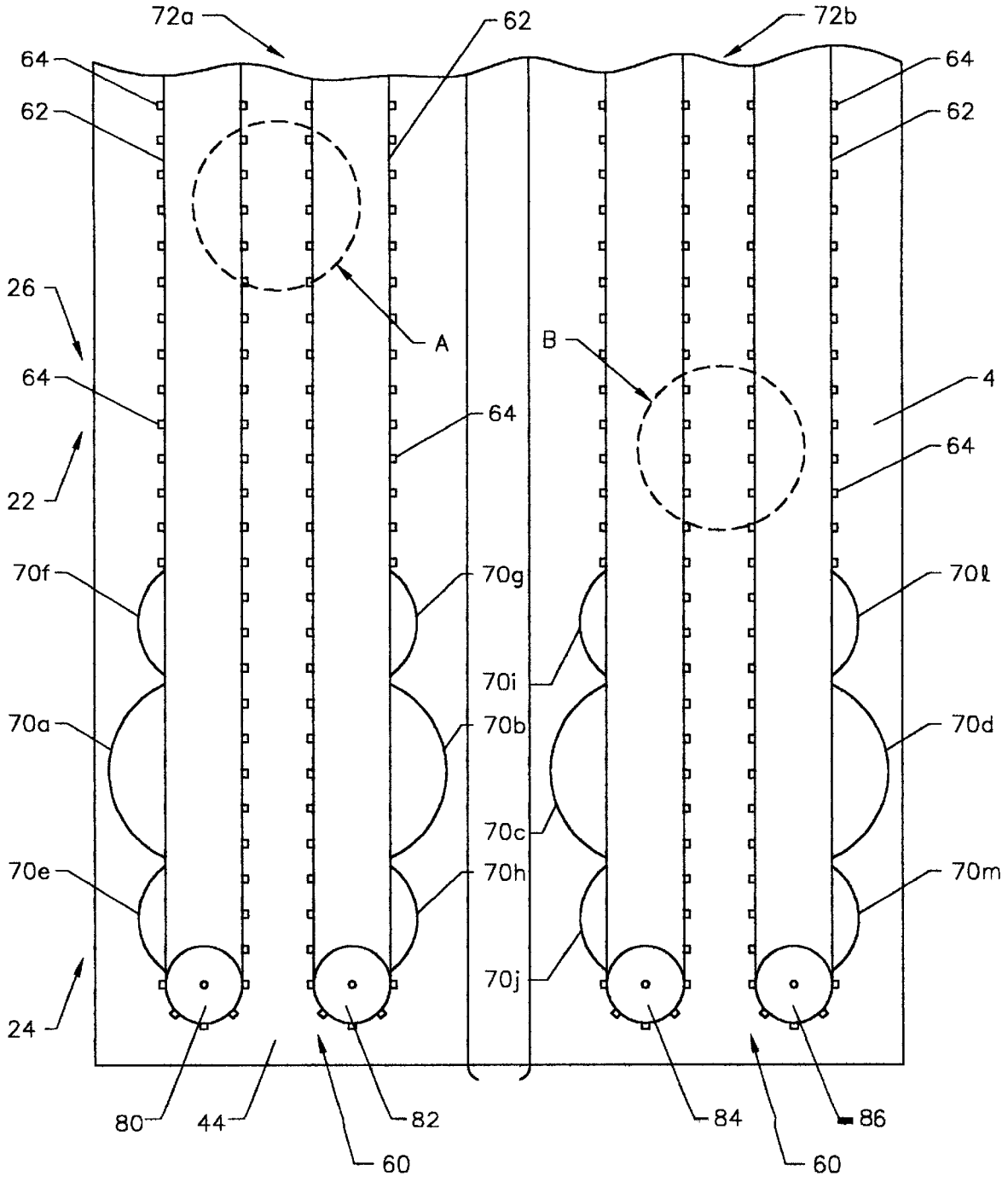
Figure 4A:
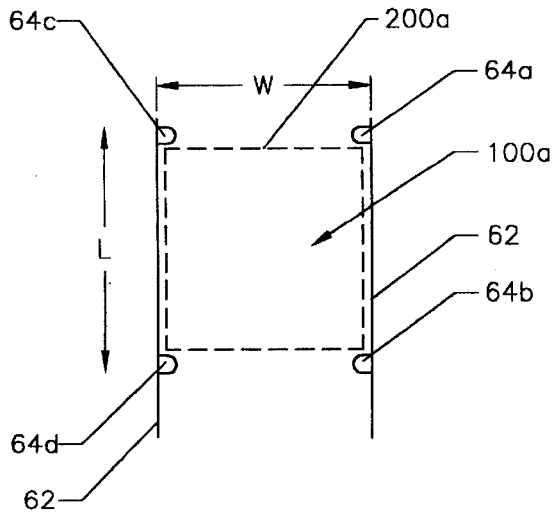
Figure 4B:
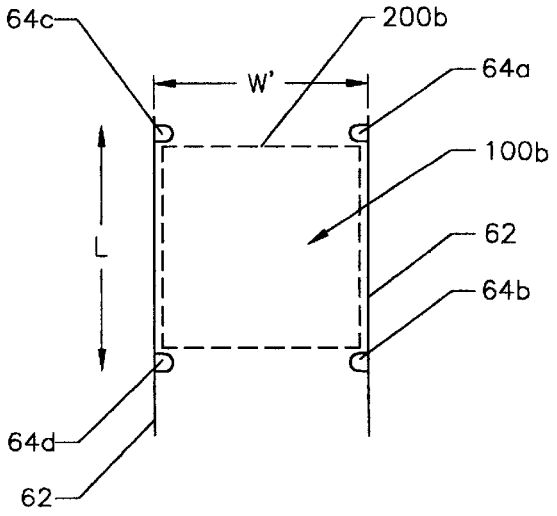
Figure 4C:
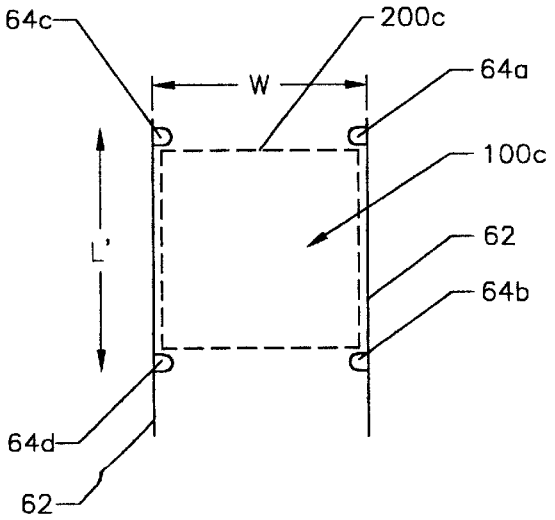
Figure 5:
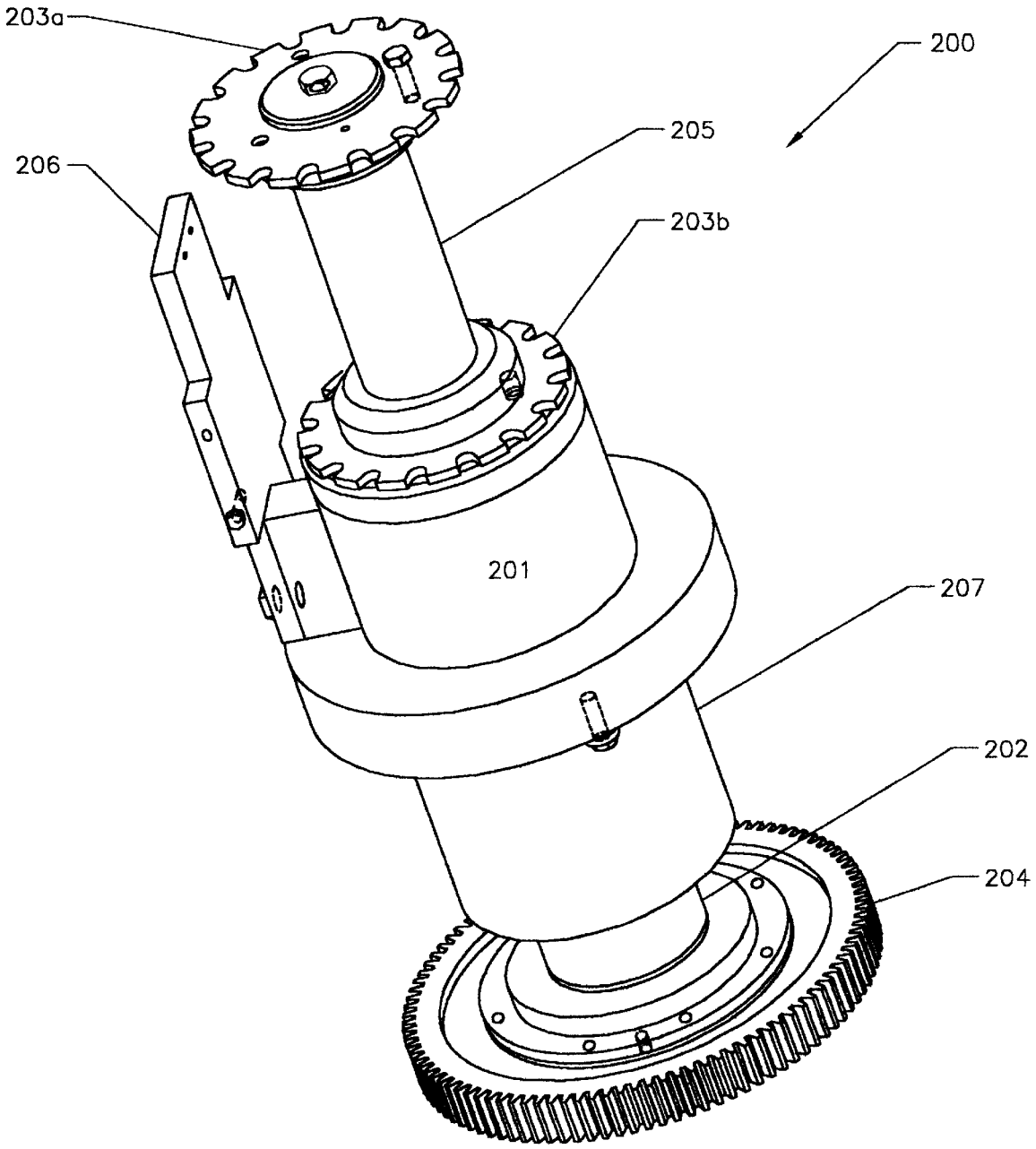
Figure 5A:
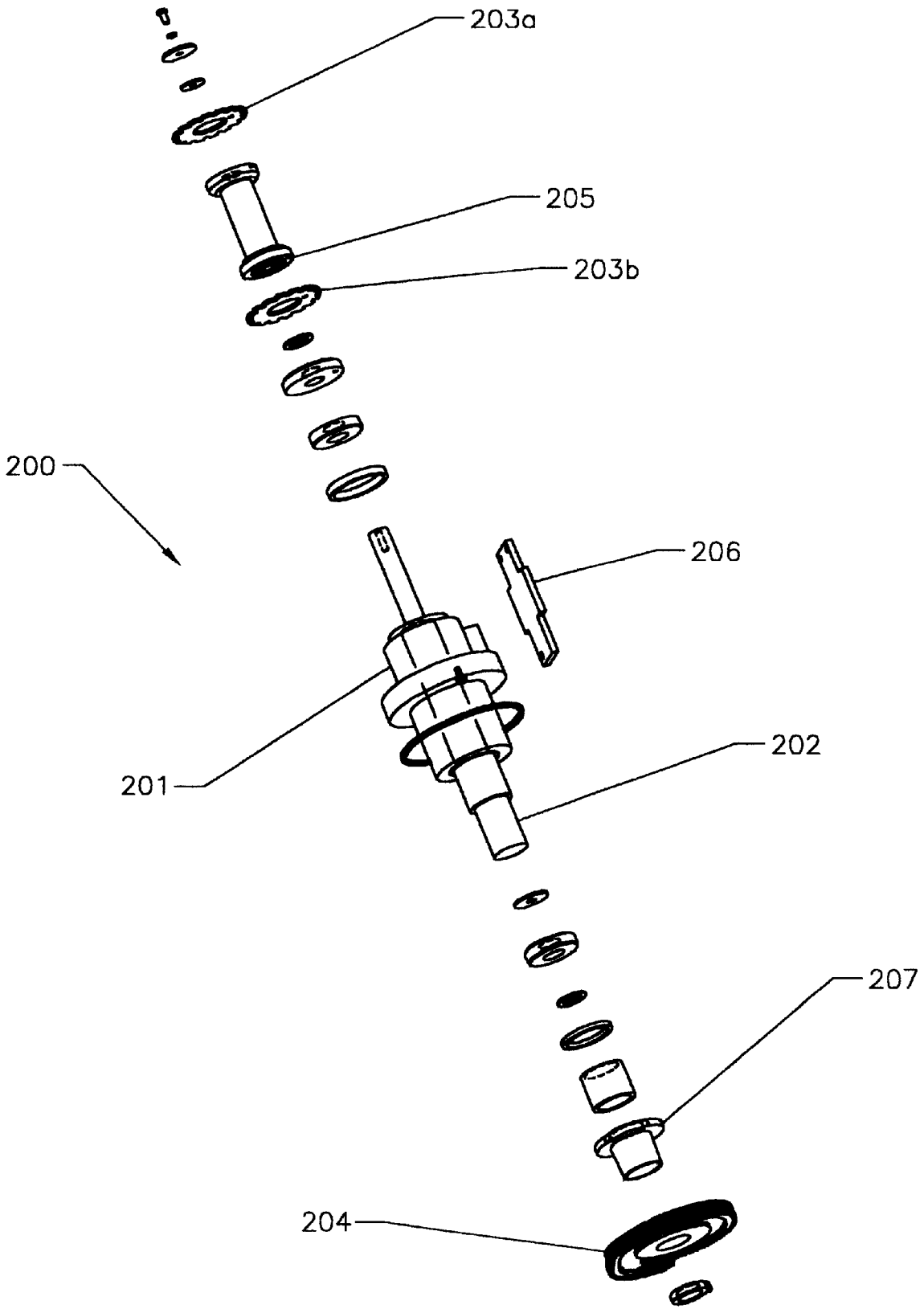
Figure 6:
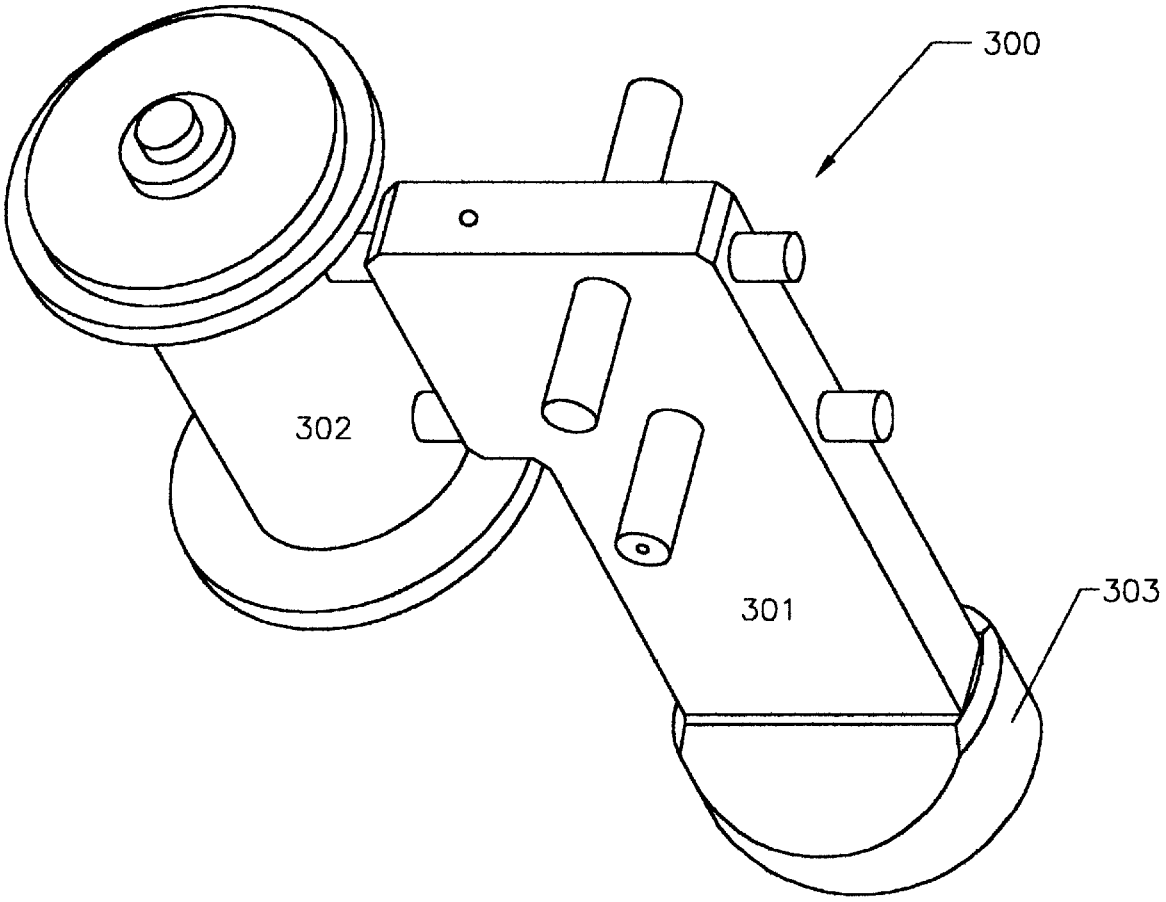
Figure 7:
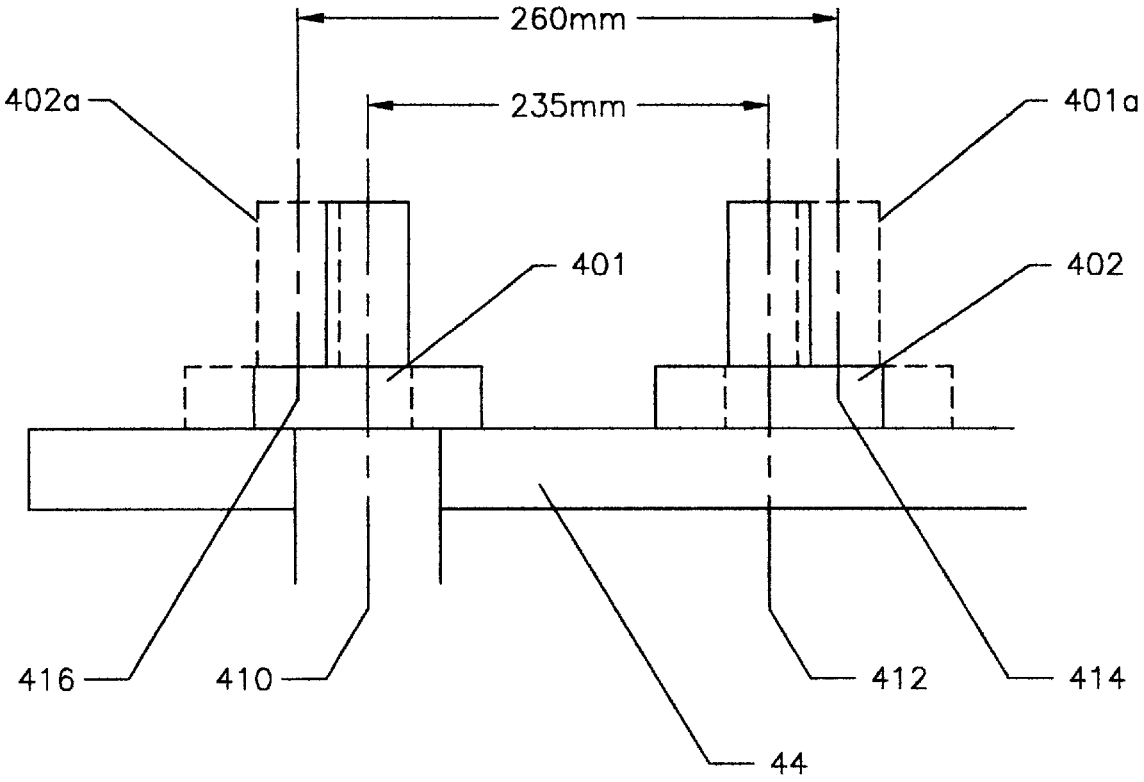

There is illustrated in FIG. 2 a top perspective view of the packaging machine of FIG. 1 without the exterior framework and the processing stations;

There is illustrated in FIG. 3 a side view of the rear upper half of the packaging machine of FIG. 1;

There is illustrated in FIG. 3A a view of FIG. 3 with the chain and overhead components removed to more clearly illustrate the upper and lower tracks and the columns;

There is illustrated in FIG. 4 a top plan view of the conveyor system of the packaging machine of FIG. 1;

There is illustrated in FIG. 4A an enlarged top view of circle A of FIG. 4 showing one possible carton pocket configuration;

There is illustrated in FIG. 4B an enlarged top view of circle B of FIG. 4 showing a second possible carton pocket configuration;

There is illustrated in FIG. 4C a third possible carton pocket configuration;

There is illustrated in FIG. 5 a perspective view of a rear conveyor column with an eccentric housing;

There is illustrated in FIG. 5A an exploded view of the rear conveyor column of FIG. 5;

There is illustrated in FIG. 6 a perspective view of a front conveyor column;

There is illustrated in FIG. 7 a schematic isolated view of alternative rear conveyor columns that may be utilized with the present invention.

Figure 8:
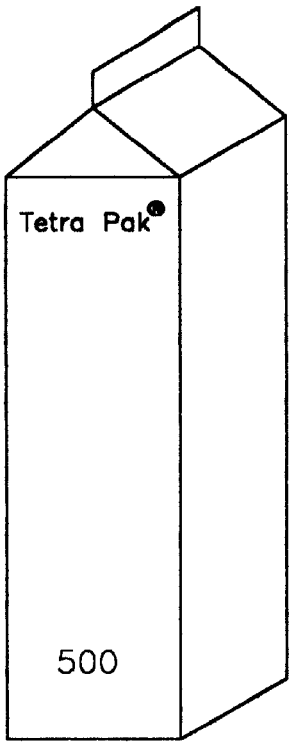
Figure 8:
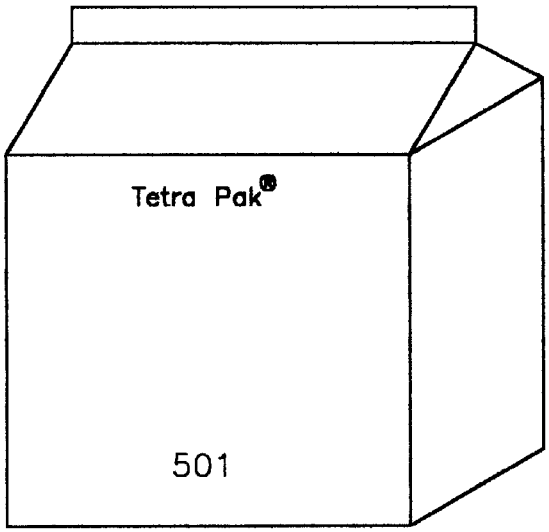

There is illustrated in FIG. 8 a top perspective view of cartons having two different cross-sections, each type of carton may be processed simultaneously on a packaging machine of the present invention.

DETAILED DESCRIPTION OF THE INVENTION

The present invention is directed in particular to a linear form, fill and seal packaging machine for gable-top cartons such as a TETRA REX® machine available from Tetra Pak, Incorporated of Chicago, Ill. The present invention allows for various size cartons to be produced on a single machine, and even two different sizes of cartons to be produced on a single machine simultaneously.

As shown in FIG. 1, a dual line packaging machine 20 for forming, filling and sealing cartons generally includes on each line a high hygiene zone 22 which is composed of a top sealing station 24 and a filling station 26, a sterilization station 28 which is composed of an ultraviolet radiation station 30 and a hydrogen peroxide station 32, a fitment applicator station, a bottom forming station 36, a modular carton opener 23 and 25, and a carton blank magazine 38. From an operational perspective, the front 40 of the packaging machine 20 is where the processing begins, and the rear 42 is where the finished cartons are dispensed for distribution.

The packaging machine 20 may be divided along a horizontal plane defined by a table top 44. The table top 44 divides the packaging machine 20 into an upper half 46 and a lower half 48. A frame 50 defines the general structure of the packaging machine 20 and supports the table top 44 and the various stations. The lower half 48 of the machine 20 includes servomotors, drive cylinders, cam drives and other components. The upper half 46 includes the various stations, the product tank 56, the filtered air system 58, the conveyor system 60, not shown in FIG. 1, and other components to process the cartons.

The conveyor system 60 is illustrated in FIGS. 2–4. The conveyor system 60 includes a plurality of continuous conveyor chains 62 having a plurality of carton guides 64 attached thereon for conveying each carton in a predetermined position for processing along the various stations of the packaging machine 20. The plurality of conveyor chains 62 are each engaged with corresponding upper guide rails 66 and lower guide rails 68.

Bridging the conveyor system 60 is the top sealer station 24 which is supported by a plurality of pedestals 70*a–m*,71 attached to the table top 44 on one end, and to the various parts of the top sealing station 24. Also bridging all of the conveyor belts 62 is the filling frame 78 that supports the filling station 26 components. Within each of the carton paths are a plurality of lifters 74*a–d*. The lifters 74*a–d* allow for bottom up filling of the cartons at the filling station 26.

The conveyor columns 80, 82, 84, 86, 88, 90, 92 and 94, that are illustrated most clearly in FIGS. 3A, 4 and 5, each have an eccentric housing 110 thereon which allows for adjustment of the width w, of the carton lines 72*a–b*. The eccentric housing 110 has at least two settings for adjustment of the width "W." However, those skilled in the art will recognize that the eccentric housing 110 may have additional settings for adjustment of the carton lines 72 *a–b* to more than two positions.

FIGS. 4A, 4B and 4C illustrate three carton pocket configurations 100*a–c* that may be utilized on a packaging machine incorporating the present invention. The carton pockets 100*a–c* are defined by the carton guides 64*a–d*. In FIG. 4A, the carton pocket 100*a* has a width W and a length L. The width W may be 70 mm and the length L may be 95 mm providing for a carton pocket 100*a* that accommodates a carton 200*a* having a 95 mm×70 mm cross section. In FIG. 4B, the width W has been adjusted by moving the conveyor columns 80–94 to the second setting. This may be accomplished by rotating the conveyor columns 80–94 by 180 degrees. The new width, W', is 95 mm while the length L is the same, 95 mm. This provides for a carton pocket 100*b* that accommodates a carton 200*b* having a 95 mm×95 mm cross section. In FIG. 4C, the length L has been adjusted to 70 mm providing a carton pocket 100*c* that accommodates a carton 200*c* having a 70 mm×70 mm. The length may be adjusted by replacing the chains 62, or by adjusting every other guide 64. The width W, W' and length L, L' only account for the cross-section of the cartons, and thus each carton pocket 100*a–c* is slightly larger than the width W, W' and length L, L' to allow for insertion and withdrawal of the various cartons from the carton pockets 100*a–c*.

Referring to FIG. 4, the carton lines 72*a* may operate with carton pockets 100*a* allowing for processing of cartons 200*a* having cross sections of 95 mm×70 mm while carton line 72*b* may simultaneously process cartons 200*b* having cross sections of 95 mm×95 mm. The present invention also provides the operator with the option to easily adjust one of the lines 72*a–b* to another carton pocket configuration 100*a–c*. Thus, if two lines of cartons 200*b* having cross sections of 95 mm×95 mm are needed by an operator, then line 72*a* may easily be adjusted to carton pocket 100*b* by rotating the conveyor columns 80, 82, 88, 90, 92 and 94.

As shown in FIGS. 5 and 5A, an eccentric housing conveyor column 200, which may be rear conveyor columns 80–86, allows for simple 180 degree rotation to switch from one carton pocket configuration to another. The column 200 has sprockets 203*a–b* connected to a hub 205 for engaging the conveyer chains 62. The column 200 also has a shaft 202 engaged on one end with a clamp hub 207 and a sub-column 201. On the other end is a gear wheel 204 which engages with the drive means for the conveyor system 60. A bracket 206 is attached to the sub-column 201. In operation, the column 200 is rotated to laterally shift the conveyor chains 62 thereby widening or narrowing the carton pockets 100*a–c*.

As shown in FIG. 6, an eccentric housing front column 300, which may be front conveyor columns 88–94, allows for simple 180 degree rotation to switch from one carton pocket configuration to another. The column 300 has a bracket 301, a hub 302 a shaft 303 and sprockets 304*a–b*. In operation, the column 300 is rotated, in tandem with column 200, to laterally shift the conveyor chains 62 thereby widening or narrowing the carton pockets 100*a–c*.

As shown in FIG. 7, an alternative means for adjusting the width of the carton pockets 100*a–c* includes switching one standard column 401 for another standard column 402. For example, column 80 would be switched with column 82 as shown in FIG. 4. Referring again to FIG. 7, switching the columns 401 and 402 would widen the carton pocket and position the columns as indicated by phantom lines 401*a* and 402*a*. The width between the center line 410 of column 401 and center line 412 of column 402 increase from 235 mm to 260 mm between center line 414 of column 401*a* and cneter line 416 of column 402*a* after the switch of columns 401 and 402.

During conversion of a line 72*a* or 72*b* from one carton pocket to another, other components of the packaging machine 20 must be adjusted to ensure proper processing of the different carton cross-section. Adjustments should be made to the carton opener 23 and 25, the bottom forming station 36 (specifically the mandrel 37 not shown), the pre-folder 39, the filling station 26 (specifically the placement of the fill pipes 114*a–b* and the lifters 74*a–d*), the top sealing station 24 (specifically the oven 115 and the sealers 116*a–b*) and if used, the sterilant sprayer at the sterilant station 32. The carton openers 23 may be modular in that an upper section 25 may be substituted with another upper section 25 when a carton with a different cross-section is to be processed on the packaging machine 20. The bottom forming station 36 needs different mandrels 37 since the bottom of the carton will different for different cross-sections. The pre-folder 39 has to be wider or narrower when converting from a carton with a rectangular cross-section from one with a square cross-section. The fill pipes 114*a–b* should be changed from fill pipes with round cross-sections for square cartons to fill pipes with elliptical cross-sections for cartons with rectangular cross-sections. An elliptical fill pipe is disclosed in co-pending U.S. patent application Ser. No. 08/812,411 which has the same assignee as the present application and is hereby incorporated by reference in its entirety.

Also, the control system must be programmed differently for different cross-sections since the indexed movements of the components of the packaging machine 20 may differ for different cross-sections. A control system for a packaging machine is disclosed in U.S. Pat. No. 5,706,627 for a Control System For A Packaging Machine which is hereby incorporated by reference in its entirety, and which has the same assignee as the present application.

To convert from a carton pocket configuration whereby the length L,L' must be changed, such as converting from a cross-section of 95 mm to 95 mm to 70 mm by 70 mm, then the conveyor chains 62 must be changed or each carton guide 64 must be adjusted to fit the new length.

As shown in FIG. 8, a carton 500 has a square cross section, and a carton 501 has a rectangular cross-section. The present invention allows for cartons having both cross sections to be processed on the same dual line machine. Also, the present invention allows for one or both lines of the packaging machine 20 to be converted from a carton having one cross-section to a carton having another cross-section.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A packaging machine for form, fill and sealing a series of cartons conveyed along a conveyance line, the packaging machine processing cartons simultaneously at a plurality of processing stations, the packaging machine comprising:

first and second continuous chain assemblies for transferring the series of cartons from and to each of the plurality of processing stations, each of the first and second continuous chain assemblies having a first plurality of guides thereon and each chain assembly connected to a front column on one end and a rear column on the other end, the front and rear columns each having an eccentric housing for moving the first and second continuous chains traverse to the conveyance line from a first position to a second position, the first position corresponding to a first carton pocket configuration and the second position corresponding to a second carton pocket configuration; and a plurality of removable fill pipes, one set of fill pipes corresponding to the first carton pocket configuration and another set of fill pipes corresponding to the second carton pocket configuration.

2. The packaging machine according to claim 1 wherein the first and second chain assemblies may be substituted for by a third and fourth chain assemblies each of the first and second continuous chain assemblies having a second plurality of guides thereon, each of the second plurality of guides placed a predetermined distance apart from adjacent guides which is different then the distance between each of the first plurality of guides, thereby creating a third carton pocket configuration.

3. The packaging machine according to claim 2 further comprising a top sealing station, the top sealing station having at least two sealers for simultaneously sealing the top of at least two of the series of cartons subsequent to filling, the sealers having a first predetermined position corresponding to sealing the top of a carton in the first carton pocket configuration, a second predetermined position corresponding to sealing the top of a carton in the second carton pocket configuration and a third predetermined position corresponding to sealing the top of a carton in the third carton pocket configuration.

4. The packaging machine according to claim 1 wherein the first plurality of carton guides connected to the chain assemblies are adjustable carton guides spaced a first predetermined distance apart from each adjacent adjustable carton guide at a first predetermined position to define a length of the first and second carton pocket configurations and each of the first plurality of carton guides having a second predetermined position defining the length of a third carton pocket configuration.

5. The packaging machine according to claim 1 further comprising a plurality of removable mandrels, a first set of mandrels corresponding to the first carton pocket configuration and another set of mandrels corresponding to the second carton pocket configuration.

6. The packaging machine according to claim 1 wherein the first carton pocket configuration corresponds to a carton having a cross section of 95 mm×95 mm and the second carton pocket configuration corresponds to a carton having cross section of 70 mm×95 mm.

7. The packaging machine according to claim 2 wherein the third carton pocket configuration corresponds to a carton having a cross section of 70 mm×70 mm.

8. A packaging machine for forming, filling and sealing a series of cartons at a plurality of processing stations, the packaging machine comprising:

a first conveyance line for transporting cartons to and from the plurality of processing stations, the first conveyance line having first and second continuous chains, each of the first and second continuous chains having a plurality of guides thereon and connected to a front column on one end and a rear column on the other end, the front and rear columns each having an eccentric housing for moving the first and second continuous chains traverse to the first conveyance line from a first position to a second position;

a second conveyance line for transporting cartons to and from the plurality of processing stations, the second conveyance line parallel with the first conveyance line, the second conveyance line having third and fourth continuous chains, each of the third and fourth continuous chains having a plurality of guides thereon and connected to a front column on one end and a rear column on the other end, the front and rear columns each having an eccentric housing for moving the third and fourth continuous chains traverse to the second conveyance line from a first position to a second position;

a plurality of first carton pockets defined by the plurality of guides and the spacing between the first and second continuous chains, the plurality of first carton pockets having a first carton configuration corresponding to the front and rear columns being in the first position, and a second carton configuration corresponding to the front and rear columns being in the second position; and a plurality of second carton pockets defined by the plurality of guides and the spacing between the third and fourth continuous chains, the plurality of second carton pockets having a first carton configuration corresponding to the front and rear columns being in the first position, and a second carton configuration corresponding to the front and rear columns being in the second position;

whereby the first conveyance line may operate in the first carton configuration while the second conveyance line operates in the second carton configuration.

9. The packaging machine according to claim 8 further comprising a top sealing station, the top sealing station having at least two sealers for simultaneously sealing the top of at least two of the series of cartons subsequent to filling, the sealers having a first predetermined position corresponding to sealing the top of a carton in the first carton configuration, and a second predetermined position corresponding to sealing the top of a carton in the second carton configuration.

10. The packaging machine according to claim 9 further comprising a plurality of removable mandrels, a first set of mandrels corresponding to the first carton pocket configuration and another set of mandrels corresponding to the second carton pocket configuration.

11. The packaging machine according to claim 8 wherein the first carton configuration corresponds to a carton having a cross section of 95 mm×95 mm and the second carton configuration corresponds to a carton having cross section of 70 mm×95 mm.

12. A packaging machine for forming, filling and sealing a series of cartons at a plurality of processing stations, the packaging machine comprising:

a first conveyance line for transporting cartons to and from the plurality of processing stations, the first conveyance line having first and second continuous chains, each of the first and second continuous chains having a plurality of guides thereon and connected to a front column on one end and a rear column on the other end, the front and rear columns each having an eccentric housing for moving the first and second continuous chains traverse to the first conveyance line from a first position to a second position;

a second conveyance line for transporting cartons to and from the plurality of processing stations, the second conveyance line parallel with the first conveyance line, the second conveyance line having third and fourth continuous chains, each of the third and fourth continuous chains having a plurality of guides thereon and connected to a front column on one end and a rear column on the other end, the front and rear columns each having an eccentric housing for moving the third and fourth continuous chains traverse to the second conveyance line from a first position to a second position; means for adjusting each of the conveyance lines to process a first carton configuration, a second carton configuration and a third carton configuration wherein the first conveyance line may simultaneously process a carton configuration different from the second conveyance line.

13. The packaging machine according to claim 12 further comprising means for adjusting a top sealing station to seal the top of a carton in a first carton configuration, a second carton configuration and a third carton configuration.

14. The packaging machine according to claim 12 further comprising means for adjusting a filling station to fill a carton in a first carton configuration, a second carton configuration and a third carton configuration.

15. The packaging machine according to claim 12 wherein the first carton configuration corresponds to a carton having a cross section of 95 mm×95 mm, the second carton configuration corresponds to a carton having cross section of 70 mm×95 mm.

16. The packaging machine according to claim 15 further comprising a plurality of adjustable carton opening devices, a first set of carton opening devices corresponding to a carton having a cross section of 95 mm×95 mm, and a second set of carton opening devices corresponding to a carton having cross section of 70 mm×95 mm.

* * * * *